United States Patent [19]

Kohler

[11] 4,192,156

[45] Mar. 11, 1980

[54] KNITTING METHOD AND APPARATUS

[75] Inventor: Fritz Kohler, Couvet, Switzerland

[73] Assignee: Edouard Dubied & Cie (Société Anonyme), Couvet, Switzerland

[21] Appl. No.: 922,642

[22] Filed: Jul. 7, 1978

[30] Foreign Application Priority Data

Jul. 25, 1977 [CH] Switzerland ..... 9173/77

[51] Int. Cl.[2] ..... D04B 7/04

[52] U.S. Cl. ..... 66/64; 66/78

[58] Field of Search ..... 66/78, 64, 62, 60, 198, 66/199

[56] References Cited

U.S. PATENT DOCUMENTS 4,100,766 7/1978 Kuhnert ..... 66/64

*Primary Examiner*—Ronald Feldbaum

*Attorney, Agent, or Firm*—Lewis H. Eslinger

[57] ABSTRACT

The relative position of one knitting system in a knitting machine is varied with respect to another knitting system to vary the stitch patterns produced by the machine. The knitting machine includes one knitting carriage having two cam holders each provided with two knitting systems. At least one of these knitting systems is associated with moving means adapted to locate the system in at least two different working positions with respect to the other knitting system.

9 Claims, 9 Drawing Figures

KNITTING METHOD AND APPARATUS

The present invention relates to a knitting method and apparatus and, more particularly, to a method and apparatus which permits the operator to readily vary the types and combinations of knitting stitches produced.

The method and apparatus of the invention are used to obtain a knit (tricot) on a knitting machine and includes the use of at least two needle beds in which needles slide, and at least one knitting carriage that include at least one knitting system per needle bed which is capable of being displaced along the needle beds in order to form rows of stitches.

Flat knitting machines provided with single or double knitting system knitting carriages, as well as so-called "merry-go-round" or carousel-type knitting machines equipped with at least two needle beds and knitting systems operating in pairs, one of them on one needle bed, and the other one on another set, are already known in the art. In general, one knitting system is integral with one cam-holder, and one cam-holder is integral with one knitting carriage. Each knitting carriage has two cam-holders and each cam-holder has one or more knitting systems. A machine of the "merry-go-round" types has several carriages.

Recent developments in knitting techniques have attempted to obtain, on a single machine, a practically finished full knit requiring practically no further assembling work. Such developments also favor so-called sequential knitting (i.e. alternating the knitting of the sleeves and of the body) in plain or ribbed knits. However, the application of such developments to conventional knitting machines has the major drawback of reducing production because knitting a tubular article, for example on a single-system machine, requires alternating shutdown of one of the two systems, depending on whether one knits on the needles of one set or the other. In such cases, production is reduced to 50% of the knitting capacity of such a machine.

It is therefore an object of the invention to provide a method and apparatus making it possible to greatly increase knit production and to increase the versatility of conventional knitting machines.

In accordance with one aspect of the present invention the relative position of one knitting system operating on one needle bed with respect to another knitting system operating on another needle bed is varied as a function of the contexture of the row of stitches to be knitted. The knitting machine which carries out this operation includes one knitting carriage having two cam-holders provided with at least two knitting systems. At least one of these knitting systems is associated with moving means adapted to locate the system in at least two distinct working positions with respect to the other knitting system.

The above, and other objects, features and advantages of the present invention will be apparent in the following detailed description of an illustrative embodiment thereof when read in connection with the accompanying drawings wherein.

Figure 4:
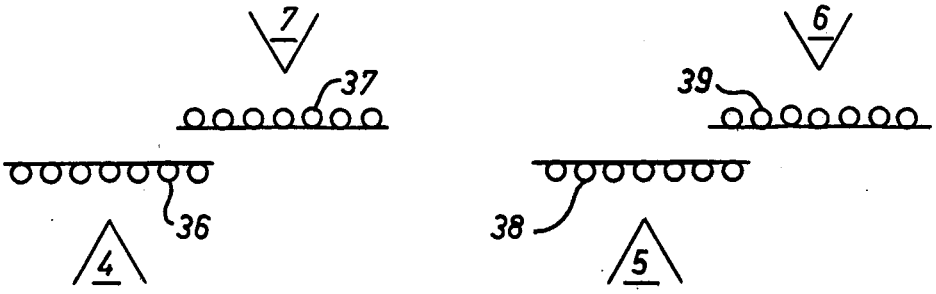
FIG. 4 is a schematic view illustrating a second variant of the arrangement of the knitting system of the invention.
Figure 5:
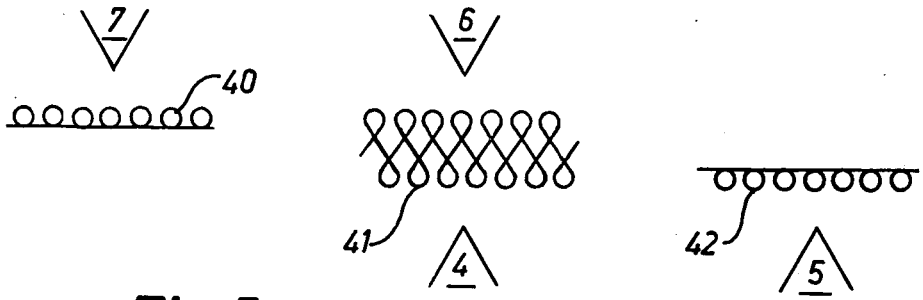
Figure 6:
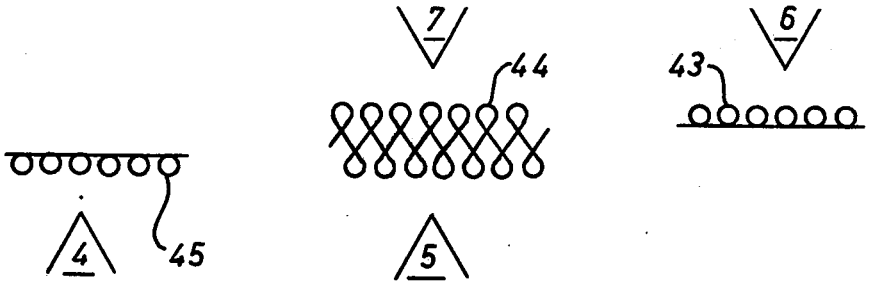
Figure 9:
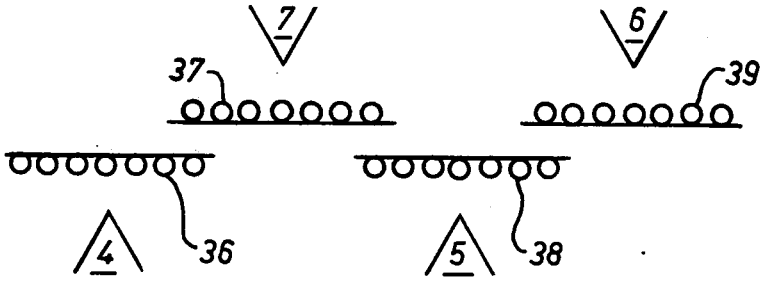
Figure 7:
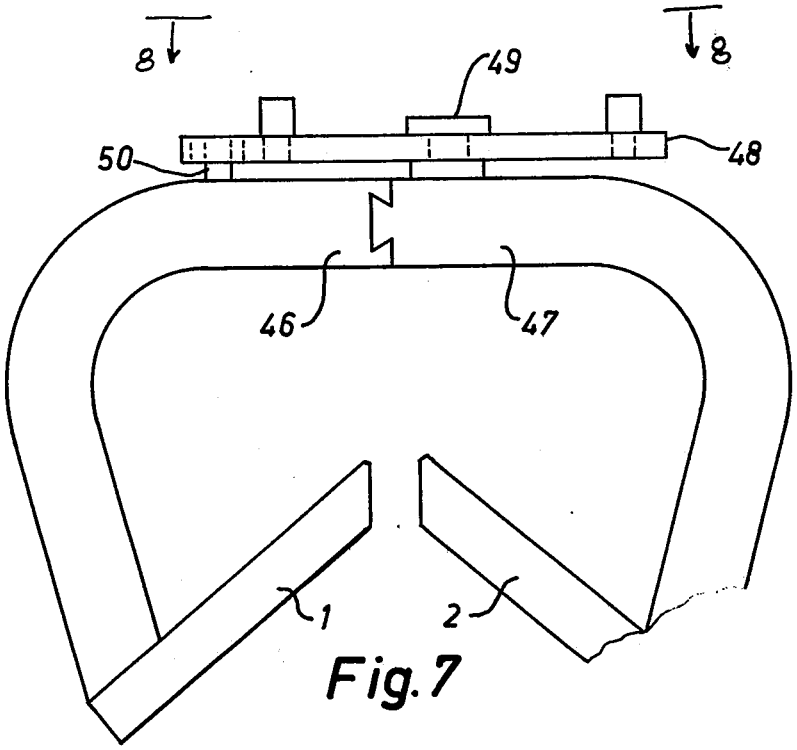
Figure 8:
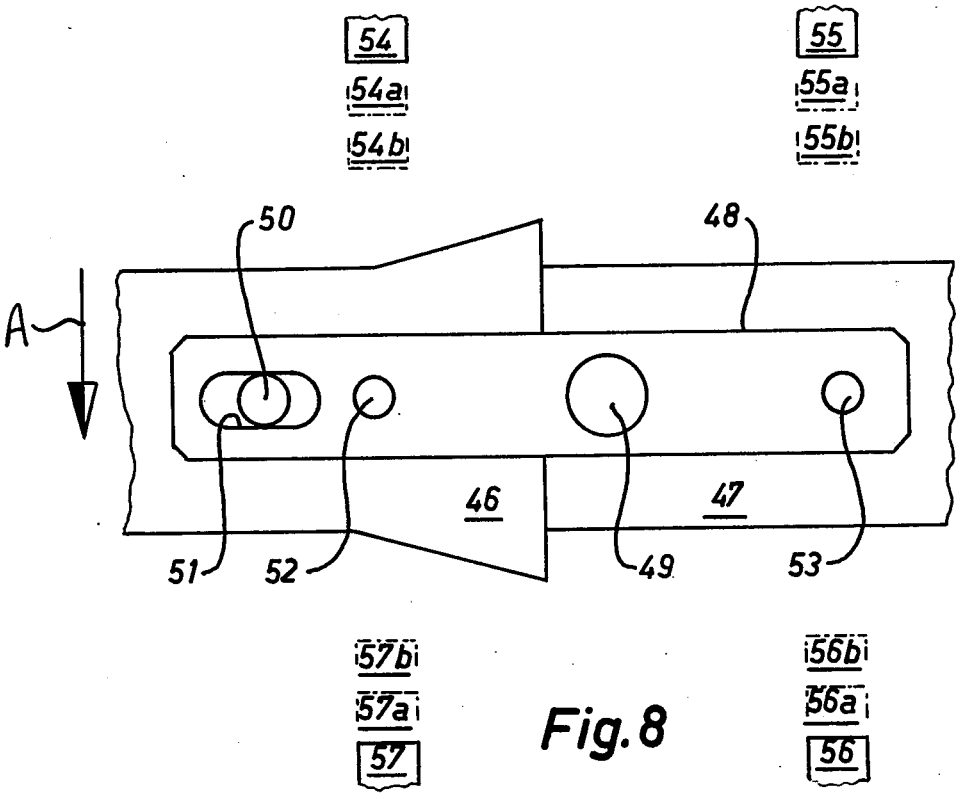

FIGS. 5 and 6 schematically illustrate a combination of the arrangement of the knitting system of the invention to obtain a particular stitch configuration;

FIG. 7 is a schematic side view of a knitting carriage illustrating another embodiment of the invention;

FIG. 8 is a partial top view, on a larger scale, of a detailed portion of FIG. 7 taken along line 8—8 therein; and FIG. 9 is a schematic illustration of a knitting carriage according to the embodiment of FIGS. 7 and 8 arranged to produce a knitting pattern similar to that of FIG. 4.

Figure 1:
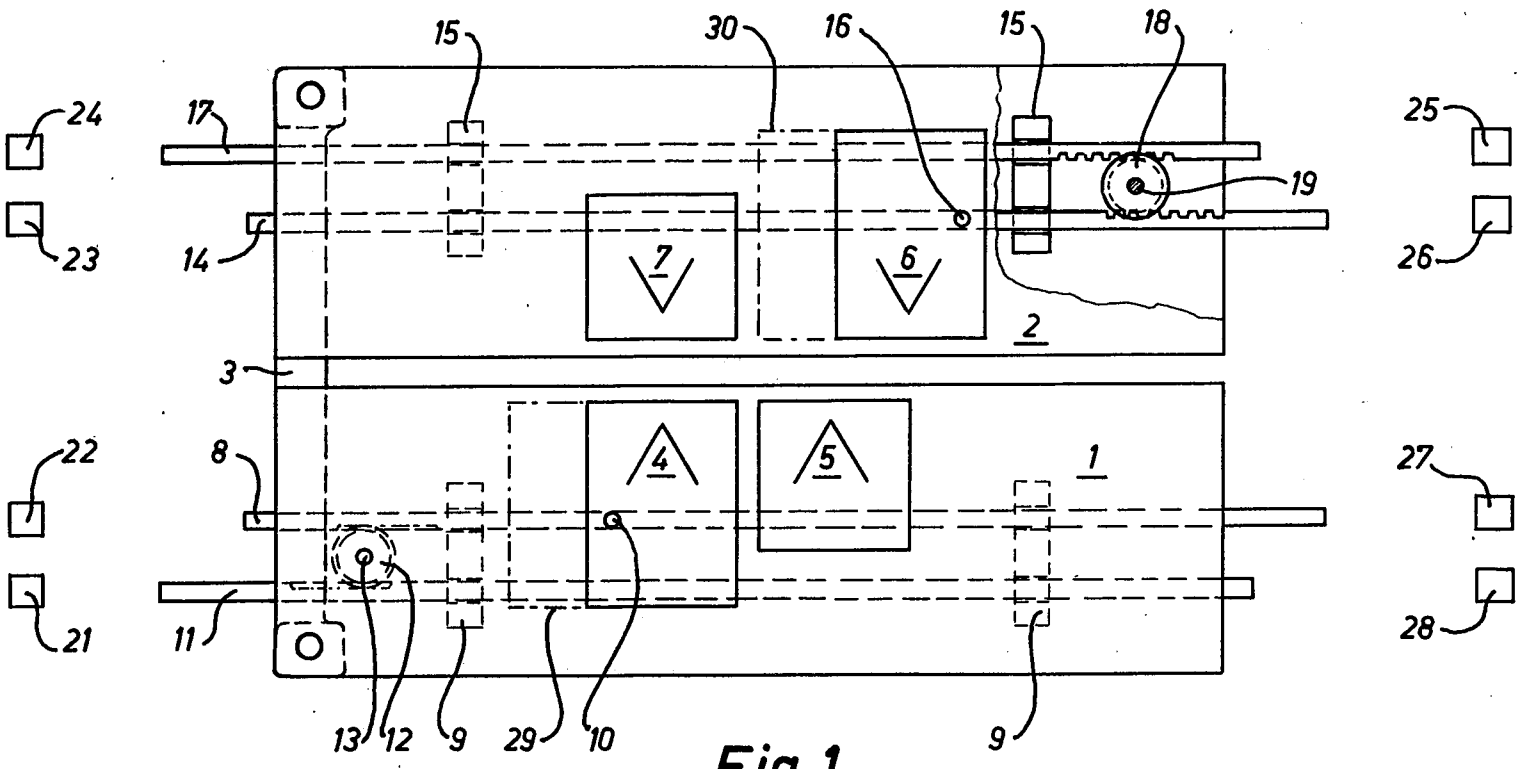
FIG. 1 is a schematic plan view, from below, of a double-system knitting carriage of a flat knitting machine constructed in accordance with one embodiment of the present invention.

Referring now to the drawings, a knitting carriage is shown in FIG. 1 which includes a front cam-holder 1 and a rear cam-holder 2 rigidly connected to each other by a yoke 3. The carriage assembly moves in a reciprocating motion along the needle beds in a known manner via means which are also known and thus are not shown. Cam-holder 1 includes a knitting system 4 (the knitting systems act on the needles butts), moving transversely in a plane parallel to the plane of the cam-holder 1. A knitting system 5 is mounted in a fixed position on cam-holder 1. A knitting system 6 is mounted on cam-holder 2 to move transversely in a plane parallel to the plane of the cam-holder 2. Finally, a knitting system 7 is mounted in a fixed position on the cam-holder 2.

A latch bar 8 is mounted in sliding fashion in supports 9 and is secured to knitting system 4 by fastening means 10 (i.e. a bolt or the like) so that knitting system 4 will move with latch bar 8. A latch bar 11 is also mounted in sliding fashion in supports 9 and gear wheel 12 is rotatably mounted on a shaft 13, secured to cam-holder 1, in meshing engagement with latch bars 8 and 11.

A latch bar 14 is mounted in sliding fashion in supports 15 secured to cam-holder 2. The knitting system 6 is secured to latch 14 for movement therewith via fastening means 16 similar to fastening means 10. A second latch bar 17 also is mounted to slide in supports 15 and meshes with a gear wheel 18 rotatably mounted on a shaft 19 on cam-holder 2. Gear wheel 18 also meshes with latch bar 14.

Reciprocating pistons 21 to 28 are mounted in a conventional manner, not shown, at the ends of the knitting machine at opposite ends of the cam-holder. They are controlled to be respectively positioned in the paths of latch bars 8, 11, 14, 17. The control of these pistons is also known and thus need not be described within the scope of the present invention.

In the arrangement shown in FIG. 1, when the knitting carriage moves from right to left and arrives at the end of its stroke, the choice of pistons 21 to 24 in operation determines the movement of the knitting systems 4 or 7. For example, operation of piston 21 will move latch bar 11 which, via gear wheel 12 and latch bar 8, moves knitting system 4 laterally towards the left. The knitting system 4 will thus take up position 29, shown in dotted lines, and will be shifted with respect to knitting system 7.

Operation of piston 24 will move latch bar 17 which, via gear wheel 18 and latch bar 14, will move knitting system 6 laterally towards the left. The knitting system 6 will thus take up position 30 shown in dotted lines and will be returned to its conventional position, opposite knitting system 5.

When the knitting carriage moves in the opposite direction, i.e., from left to right, piston 27 and latch bar 8, as well as piston 26 and latch 14, will move in the same manner.

Figure 2:
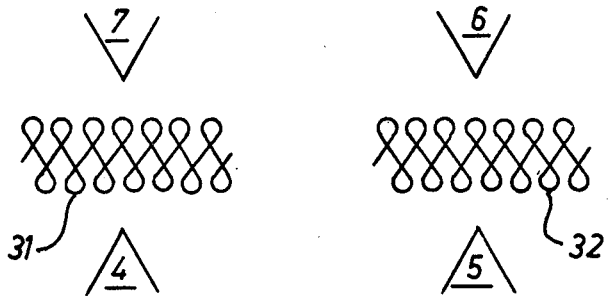
Fig. 2 (Prior Art)
FIG. 2 is a schematic view of a conventional double-system knitting carriage and the knitting stitch produced thereby.
Figure 3:
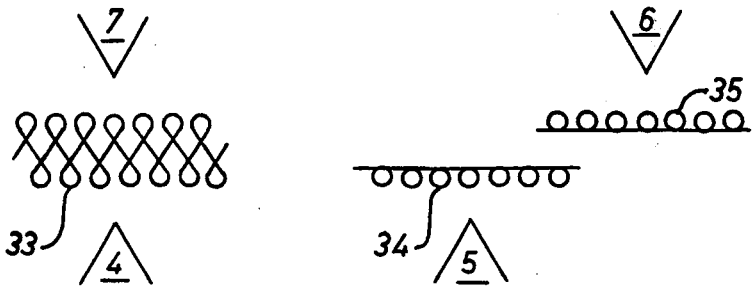
FIG. 3 is a schematic view, similar to FIG. 2, of a knitting carriage illustrating a first variant of the arrangement of the knitting system of the present invention.

In a conventional flat knitting machine with a double system, knitting system 4 is opposite knitting system 7, and knitting system 5 is opposite knitting system 6, as shown schematically in FIG. 2. In this position, knitting systems 4 and 5, respectively, cooperate with knitting systems 7 and 6, respectively, to form rows of stitches 31, 32, respectively, common to the needles of the two needle beds. By varying the relative position of knitting system 6 with respect to knitting system 5, we obtain the situation of FIG. 3. That is, knitting system 4 cooperates with knitting system 7 to form a row of stitches common to the needles of the two needle beds, while knitting systems 5 and 6 each operate individually to form rows of stitches 34, 35 common to their respective needle bed. In one carriage pass it is thus possible to knit three rows of stitches, i.e. a row of ribbed knit 33 and two rows of plain knit 34, 35, for example. By varying the relative position of the two knitting systems operating on one needle bed with respect to the two knitting systems 7 and 6 operating on the other needle bed, the knitting pattern shown in FIG. 4 can be obtained. In this case in one single knitting carriage pass it is possible to knit four independent rows of stitches 36, 37, 38 and 39, i.e. two rows of plain knit 37, 39 on the rear, and two rows of plain knit 36, 38 on the front.

Various other possible combinations of the knitting system can be selected, as will be apparent from the above description, but the one described in connection with FIGS. 5 and 6, which makes it possible to knit a special complete knit configuration called "Milanese Knit" with each movement of the knitting carriage, should be particularly noted. As seen therein, upon movement from right to left, the situation of the knitting systems is, for example, that shown in FIG. 5. Three rows of stitches are knitted, one row of plain knit 40 on the rear, one row of ribbed knit 41 and one row of plain knit 42 on the front. When the carriage reaches its leftmost position, the relative positions of the knitting system are modified so that they are arranged as shown in FIG. 6 during movement of the carriage from left to right. Knitting system 5 is opposite knitting system 7. This will result in three rows of stitches, one row of plain knit 43 on the rear, one row of ribbed knit 44 and one row of plain knit 45 on the front. Thus, with one round trip of the carriage, two rows of "Milanese Knit" stitches are produced. The modification of the knitting systems between the position of FIG. 5 and that shown in FIG. 6 can be effected advantageously by moving the cam-holders with respect to one another. Such a movement may, for example, be generated by the arrangement shown in FIG. 7. As shown in FIG. 7, in this embodiment, cam-holders 1 and 2 are connected via two half-yokes 46 and 47 which are connected to each other via a slide adjustment commonly called an "eagle tail" or "dove tail" adjustment. A lever 48 is pivotally mounted on a shaft 49 which is mounted on yoke 47. An eyebolt 50 is secured to yoke 46 and emerges in an opening 51 (FIG. 8) of the lever 48. The latter has two pins 52, 53 rigidly secured thereto. Tops 54, 55, 56, 57 are provided at the ends of the knitting machine as schematically illustrated in FIG. 8. These stops may be controlled to take up different positions shown in dotted lines and noted by the addition of indices a, b. Attachment and control of such stops in the knitting machine are known and will not be described within the scope of the present invention.

In order to move cam-holder 1 with respect to cam-holder 2, it is sufficient to move half-yoke 47. In the position shown in FIG. 8, the cam-holders are arranged with respect to one another in the conventional manner wherein the knitting systems are opposite each other. To move half-yoke 46 in the direction indicated by the arrow A when the knitting carriage moves in the same direction, it is sufficient to locate or position stop 56 in its position **56*b*. When the knitting carriage arrives at the end of its stroke, pin 53 will be stopped by stop 56 (at 56*b*) and this will cause lever 48 to rotate about its shaft 49. Via eyebolt 50, half-yoke 46 will be moved in the direction indicated by arrow A to be brought into a shifted position with respect to half-yoke 47**.

The same movement of half-yoke 46 may be obtained when moving the carriage in reverse direction by operating a positioning stop 54 in its position **54*b*. A movement of half-yoke 46 in the direction opposite that indicated by the arrow A is effected by stops 57 or 55 in their position 57*b* or 55*b*, respectively, depending on the direction of movement of the knitting carriage. The selection of a stop 54 to 57 in a position 54*a*, 55*a*, 56*a*, or 57*a*, shall result in the half-yoke 46 being returned to its conventional position, opposite half-yoke 47**.

An arrangement of the knitting systems similar to that shown in FIG. 4 may also be obtained by the variant in accordance to FIGS. 7 and 8. In this case, it is necessary to provide additional stop positions which would make it possible to move one cam-holder with respect to another in order to obtain a symmetrical distribution of the knitting systems such as shown in FIG. 9.

The operator of the present invention thus has available to him a machine which enables him to manufacture articles in a much more productive manner, without having to increase knitting speeds. By the combining of the knitting systems among each other and the combining of the two mechanical variants shown, he will be able to increase the versatility of his production by turning out a far broader range of articles economically with one and the same machine.

Although illustrative embodiments of the present invention have been described herein with reference to the accompanying drawings, it is to be understood that the invention is not limited to those precise embodiments and that various changes and modifications may be effected therein by those skilled in the art without departing from the scope or spirit of this invention.

What is claimed is:

1. The method of obtaining a knit on a knitting machine having at least two needle beds in which needles can slide and at least one knitting carriage including a pair of cam plates each of which has a knitting system mounted thereon comprising the steps of reciprocating said carriage to form rows of stitches and selectively varying the relative position of one knitting system on one cam plate with respect to the knitting system on the other cam plate during displacement of the knitting carriage thereby to change the stitch pattern produced by the machine.

2. The method as defined in claim 1 including the step of positioning the knitting systems directly opposite each other in order to knit a knit pattern common to the needles of the two needle beds.

3. The method of obtaining a knit on a knitting machine having at least two needle beds in which needles can slide and at least one knitting carriage including a pair of cam plates each of which has two knitting systems mounted thereon, said method comprising the steps of reciprocating said carriage to form rows of stitches and selectively varying the relative position of one knitting system on one cam plate with respect to the knitting system on the other cam plate thereby to change the stitch pattern produced by the machine, said varying step including the steps of shifting one of the knitting systems on one cam plate with respect to one of the knitting systems on the other cam plate during each reciprocation of the carriage thereby to knit two knit contextures each being common to the needles of one needle bed system.

4. The method of obtaining a knit on a knitting machine having at least two needle beds in which needles can slide and at least one knitting carriage including a pair of cam plates each of which has two knitting systems mounted thereon, said method comprising the steps of reciprocating said carriage to form rows of stitches and selectively varying the relative position of one knitting system on one cam plate with respect to the knitting system on the other cam plate thereby to change the stitch pattern produced by the machine;

said varying step comprising the steps of moving both knitting systems on one cam plate with respect to both knitting systems on the other cam plate so that the last knitting system in one needle bed, seen in the direction of movement of the knitting carriage, cooperates with the first knitting system in the other needle bed so as to knit, in one carriage pass three knit contextures, one of which is common to the needles of one needle bed, a second one common to the needles of the two needle beds and a third one common to the needles of the other needle bed.

5. A knitting machine including a knitting carriage, a pair of cam-holders on said carriage; each of said cam holders including at least two knitting systems comprising means for knitting; and means for selectively changing the position of at least one of said knitting systems, between at least two distinct working positions, with respect to the other of said knitting systems during displacement of the knitting carriage.

6. A knitting machine including a knitting carriage, a pair of cam holders on said carriage; each of said cam holders including at least two knitting systems; and means for selectively changing the position of at least one of said knitting systems between at least two distinct working positions with respect to the other of said knitting systems; and means for movably mounting said at least one knitting system on its associated cam holder and wherein said changing means comprises means for moving said at least one knitting system on its cam holder.

7. A knitting machine including a knitting carriage, a pair of cam holders on said carriage; each of said cam holders including at least two knitting systems; and means for selectively changing the position of at least one of said knitting systems between at least two distinct working positions with respect to the other of said knitting systems; said selective changing means comprising means for moving one of said cam holders with respect to the other.

8. A knitting machine as defined in claim 7 wherein said changing means comprise a pair of latch bars, slidably mounted on said associated cam plate, a gear wheel rotatably mounted on said associated cam plate and engaged with said latch bars, one of said latch bars being connected to said one knitting system and piston means for selectively moving said latch bars.

9. A knitting machine as defined in claim 7 wherein said changing means include a pair of slidably connected half yoke members respectively connected to said cam plate, a lever pivotally mounted on one of said yokes; an eyebolt mounted on the other of said yokes and received in a slot in said lever and selectively positionable stop means for engaging said lever upon reciprocation of said carriage.

* * * * *